US005506659A

United States Patent [19]

Hori

[11] Patent Number: 5,506,659

[45] Date of Patent: Apr. 9, 1996

[54] IMAGE DENISTY CONTROL DEVICE HAVING AN ORIGINAL MOUNTING ELEMENT WITH A VERTICALLY ADJUSTABLE MEANS

[75] Inventor: Kazuto Hori, Osaka, Japan

[73] Assignee: Mita Industrial Co., Ltd. (a corp. of Japan), Osaka, Japan

[21] Appl. No.: 262,660

[22] Filed: Jun. 20, 1994

[30] Foreign Application Priority Data

Jul. 16, 1993 [JP] Japan ..... 5-198985

[51] Int. Cl.[6] ..... G03G 21/00

[52] U.S. Cl. ..... 355/208; 355/69; 355/77; 355/228

[58] Field of Search ..... 355/38, 77, 69, 355/208, 214, 228, 204, 246; 358/296, 300; 118/688, 689

[56] References Cited

U.S. PATENT DOCUMENTS

| | | | |
|---|---|---|---|
| 4,313,671 | 2/1982 | Kuru | 118/688 X |
| 4,806,775 | 2/1989 | Uchida | 250/578 |
| 4,860,059 | 8/1989 | Terashita | 355/38 |
| 4,922,087 | 5/1990 | Nakajima et al. | 250/201.4 |
| 4,931,827 | 6/1990 | Yoshino | 355/38 |
| 4,982,232 | 1/1991 | Naito | 355/208 |
| 5,195,148 | 3/1993 | Sugiura | 382/47 |
| 5,214,518 | 5/1993 | Kato | 358/448 |

*Primary Examiner*—A. T. Grimley
*Assistant Examiner*—Thu A. Dang
*Attorney, Agent, or Firm*—Beveridge, DeGrandi, Weilacher & Young

[57] ABSTRACT

The present invention is directed to an image density control device in an image formation apparatus where a pattern of reference density on a sample original is exposed to light from an exposing light source to image the pattern on photoconductor, density of the resultant toner image is detected by a reflection-type photosensor, and parameters on image density are adjusted based upon results of detection by the reflection-type photosensor. In the image density control device in the image formation apparatus, the sample original is mounted on a cabinet of the image formation apparatus so that a distance from the exposing light source in illuminating the pattern of the reference density to the pattern of the reference density can be adjusted.

4 Claims, 4 Drawing Sheets

IMAGE DENSITY CONTROL DEVICE HAVING AN ORIGINAL MOUNTING ELEMENT WITH A VERTICALLY ADJUSTABLE MEANS

FIELD OF THE INVENTION

The present invention relates to an image density control device in an image formation apparatus such as a copying machine and the like.

PRIOR ART TECHNOLOGY

In a copying machine, usually an original image is exposed to light to form an electrostatics latent image on a photoconductor drum. After that, the electrostatic latent image is developed by a developing device to form a toner image on the photoconductor drum, and the toner image is transferred to a recording sheet by a transfer device.

To obtain appropriate image density, a fixed density of the toner image related to a specified density of an original image must be retained. Thus, in the prior art, parameters on density including the quantity of exposing light, charging potential in photoconductor, and developing bias is adjusted as discussed below.

Specifically, a pattern of reference density on a sample original attached to the copying machine is exposed to light by an exposing lamp to form an electrostatic latent image of the pattern of the reference density on a photoconductor drum. After development of the image, density of the resultant toner image on the photoconductor drum is detected by a reflection-type photosensor. Eventually, the parameters on density are adjusted based upon output from the reflection-type photosensor.

The sample original is fixed external to one side or opposite sides of a contact glass plate by a mounting element. Hence, due to the causes as stated below, there arise variations in the quantity of light reflected from the sample original, and this brings about an adverse effect upon adjustment of the parameters on density. For example, a size error in the mounting ,element for the sample original causes variations in distance from the exposing lamp to the sample original, illuminating angle of light from the exposing lamp to the sample original, and so on. Also, a mounting error caused in mounting the sample original on the copying machine variations in distance from the exposing lamp to the sample original, illuminating angle of light from the exposing lamp to the sample original, and so on. Moreover, radiant heat from the exposing lamp transforms the sample original.

SUMMARY OF THE INVENTION

It is an object of the present invention to provide an image density control device in an image formation apparatus in which variations in the quantity of light reflected from a sample original can be corrected, and parameters on density can be precisely performed.

In an image density control device in an image formation apparatus according to the present invention where a pattern of reference density on a sample original is exposed to light from an exposing light source to image the pattern on photoconductor, density of the resultant toner image is detected by a reflection-type photosensor, and parameters on image density are adjusted based upon results of detection; the sample original is attached to a cabinet of the image formation apparatus so as to adjust a distance from the exposing light source illuminating the pattern of the reference density to the pattern of the reference density.

Light from the exposing light source illuminates the pattern of the reference density on the sample original, the quantity of light reflected from the pattern is detected by a light quantity detector, and a distance from the exposing light source to the pattern of the reference density is adjusted so that the the quantity of light detected by the light quantity detector can reach a predetermined level.

In accordance with the present invention, since the distance from the exposing light to the pattern of the reference density in exposing the pattern to light can be adjusted, variations in distance between the exposing lamp and the sample original, variations in illuminating angle of light from the exposing lamp to the sample original, and so forth caused by a size error of a mounting element for the sample original, an mounting error in mounting the sample original on the copying machine, and the like can be corrected. Thus, since variations in the quantity of light reflected from the sample original can be corrected, parameters on density can be precisely adjusted.

For example, the sample original can be mounted on a top panel of the image formation apparatus so that its vertical position can be adjusted as required. The pattern of the reference density on the sample original is illuminated with light from an exposing light source, the quantity of light reflected from the sample original is detected by a light quantity detector, and the sample original can be adjusted in its vertical position relative to the top panel of the image formation apparatus so that the quantity of light detected by the light quantity detector reaches a predetermined value.

DETAILED DESCRIPTION OF THE PREFERRED EMBODIMENT

A preferred embodiment of the present invention will be described below with reference to the accompanying drawings.

Figure 1:
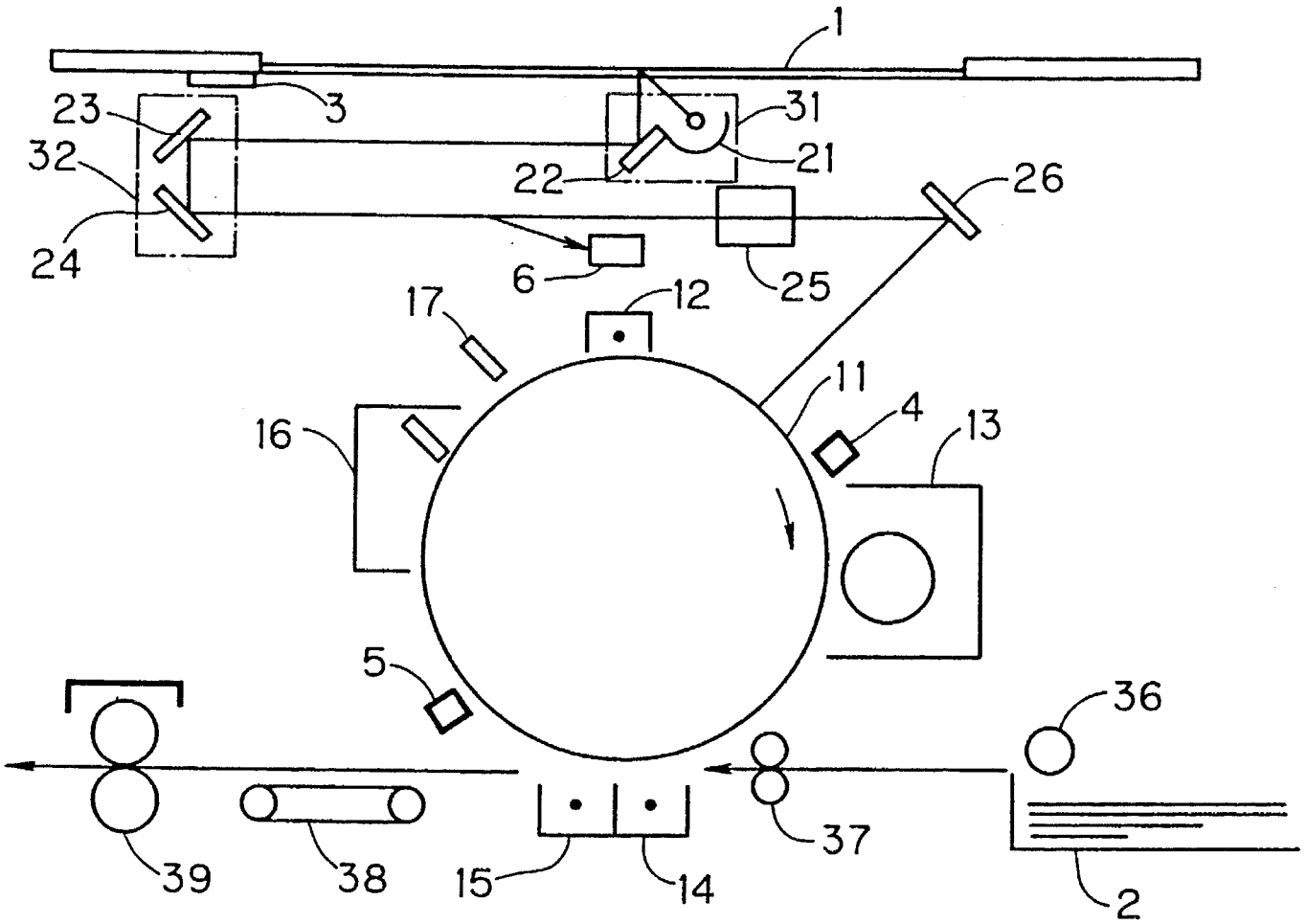
FIG. 1 is a schematic diagram showing an arrangement of a copying machine.

FIG. 1 depicts an arrangement of an electrophotographic copying machine.

In an upper portion of a cabinet of the copying machine, there is a contact glass plate 1 on which an original sheet to be copied is mounted. In one side of the cabinet of the copying machine, a sheet cassette 2 is attached. Within the cabinet of the copying machine, an exposing mechanism, a printing mechanism and a recording sheet carrying mechanism are disposed. Close to a side of the contact glass plate 1, a sample original 3 where a pattern of reference density is recorded is placed.

The printing mechanism has a photoconductor drum 11 which is revolved in a direction of arrow in FIG. 1 by a main motor not shown. Surrounding the photoconductor drum 11, an electrostatic charger 12 for electrifying a photoconductive layer in surface of the photoconductor drum 11, a developing device 13 for imaging an electrostatic latent image formed on the photoconductive layer as a toner image, a transfer discharger 14 for transferring the toner image on the photoconductive layer onto a recording sheet, a release discharger 15 for releasing the recording sheet from the photoconductor drum 11, a cleaning device 16 for removing toner remaining on the photoconductor drum 11 after image transfer, and a discharging device 17 for releasing electric charge from the surface of the photoconductor drum 11 are disposed in order of rotation of the photoconductor drum.

Also, around the photoconductor drum 11, a surface potential sensor 4 for measuring charging potential of the photoconductor drum 11 and a reflection-type photosensor 5 for measuring density of the toner image relative to the pattern of the reference density on the sample original are arranged.

The exposing mechanism includes a first optical carriage 31 having an exposing lamp 21 for exposing to light and scanning an image of an original sheet (not shown) on the contact glass plate 1 and a first mirror 22 reflecting light reflected from the original sheet, a second optical carriage 32 having second and third mirrors 23 and 24 for guiding light reflected from the first mirror 22 toward a lens 25, and a fourth mirror 26 for guiding light outgoing from the lens 25 onto the surface of the photoconductor drum 11. Furthermore, a light quantity sensor 6 for measuring the quantity of light reflected from the sample original 3 is put in position.

The first and second optical carriages 31 and 32 are reciprocally moved in lateral directions in FIG. 1 By a scan motor not shown. The second optical carriage 32 moves ½ times as fast as the first optical carriage 31, and it moves ½ times as far as the first optical carriage 31.

The recording sheet carrying mechanism includes a sheet supply roller 36 for supplying a recording sheet from the sheet cassette 2, a resist roller 37 for conveying the recording sheet from the sheet supply roller 36 to the photoconductor drum 11 at a specified timing, and a conveyer belt 38 for conveying to a fusing roller 39 the recording sheet which has the toner image transferred from the photoconductor drum 11 and released from the photoconductor drum 11.

Adjustment of image: density is performed as follows: First, the pattern of the reference density on the sample original 3 is exposed to light from the exposing lamp 21 to image the pattern of the reference-density on the photoconductor drum 11 as an electrostatic latent image, and after development of the electrostatic latent image, density of the resultant toner image on the photoconductor drum 11 is detected by the reflection-type photosensor 5. Thus, based upon output from the reflection-type photosensor 5, parameters on density including the quantity of exposing light, charging potential of the photoconductor drum 11, and developing bias are adjusted.

Figure 2:
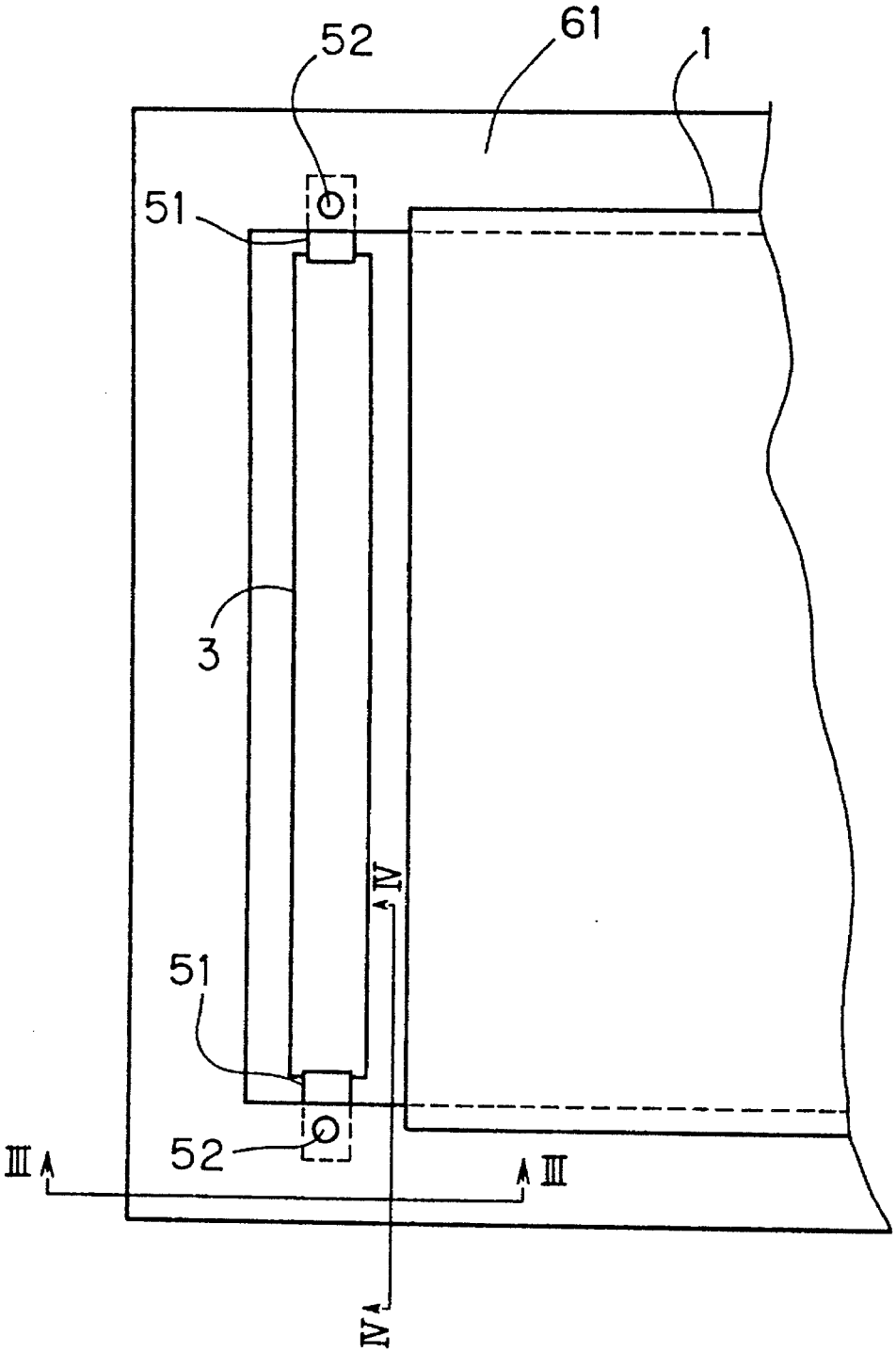
FIG. 2 is a partial enlarged perspective view showing a manner of mounting a sample original.
Figure 3:
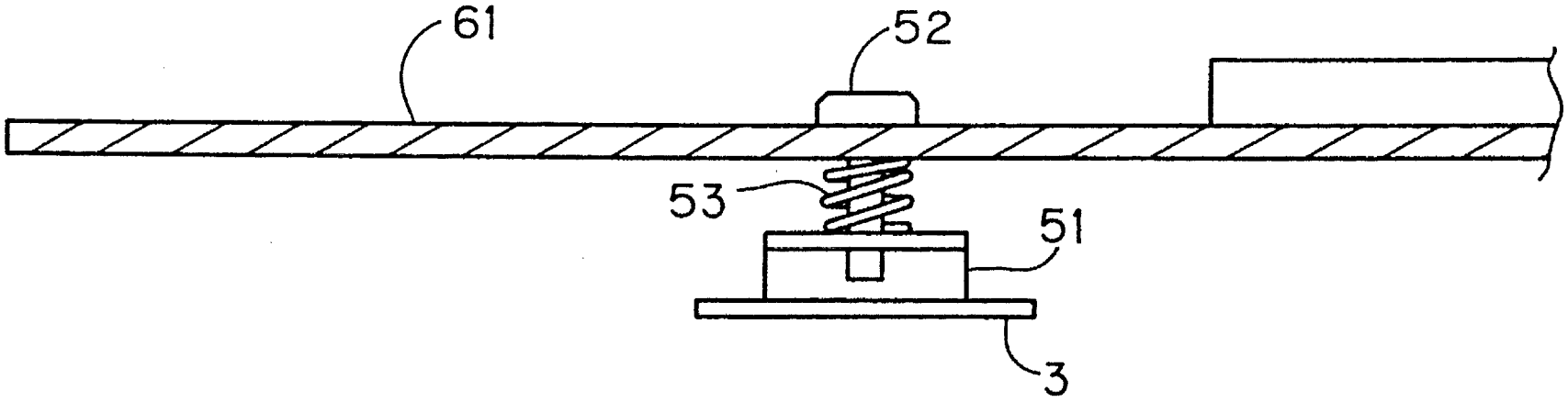
FIG. 3 is a sectional view taken along the line III—III of FIG. 2.
Figure 4:
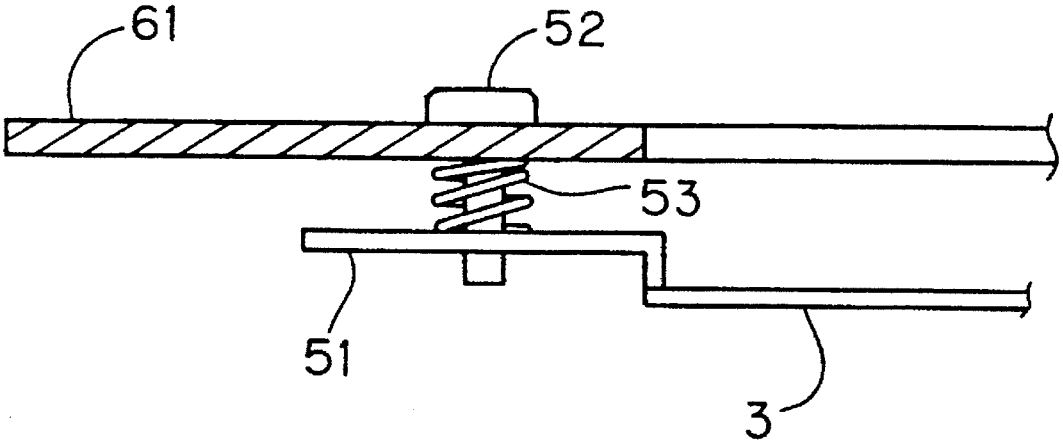
FIG. 4 is a sectional view taken along the line IV—IV of FIG. 2.

FIGS. 2 to 4 illustrate a manner of mounting the sample original.

The sample original 3 is shaped in a long rectangle. The sample original 3 is made of substance, such as metal, resin and the like, which does not easily undergo thermal transformation. In opposite ends of the sample original 3, L-shaped members 51, each having a tapped hole, are attached. In a top panel 61 of the cabinet of the copying machine, two tapped holes are formed external to one side of the contact glass plate 1.

Screw bolts 52, inserted and screwed from above into the tapped holes, are engaged with the tapped holes of the L-shaped members 51 to fix the sample original 3 to the top panel 61. A compression coil spring 53 is fitted on each of the screw bolts 52 to urge the L-shaped member 51 downward against the top panel 61. The compression coil spring 53 prevents the sample original 3 from being rickety due to vibration of the copying machine. A vertical position of the sample original 3 is adjusted by tightly turning or loosening the bolts 52.

In mounting the sample original 3, for example, the vertical position of the sample original 3 is adjusted as follows: The pattern of the reference density on the sample original 3 is illuminated with light from the exposing lamp 21. The quantity of light reflected from the sample original 3 is detected by the light quantity sensor 6, and the bolts 52 are turned and adjusted so that detection output from the light quantity sensor 6 reaches a predetermined value.

In accordance with this embodiment, variations in the quantity of light reflected from the sample original 3 due to a mounting error of the sample original 3 can be corrected. Thus, adjustment of image density can be performed more precisely.

As to the manner of mounting the sample original 3, examples other than that discussed in the above embodiment may be employed so far as a distance from the exposing lamp 21 illuminating the sample original 3 to the pattern of the reference density can be adjusted.

What is claimed is:

1. An image density control device for an image formation apparatus, said device comprising an exposing light source for illuminating and exposing a pattern of a reference density on a sample original to image the pattern on a photoconductor as a toner image, a reflection-type photosensor for detecting the density of the toner image, parameters on image density being adjustable based upon detecting results from the reflection-type photosensor, and a mounting element for mounting the sample original on an image formation apparatus cabinet, the mounting element having vertically adjustable means for vertically positioning the sample original so as to adjust a distance from the exposing light source to the pattern of the reference density.

2. A device according to claim 1, further comprising a light quantity detecting device for, when the pattern of the reference density on the sample original is illuminated with light from the exposing light source, detecting a quantity of light reflected from the sample original, a distance from a exposing light source to the pattern of the reference density being adjusted so that the quantity of light detected by the light quantity detecting device reaches a predetermined value.

3. A device according to claim 1, wherein the vertically adjustable means is adapted for location on a top panel of an image formation apparatus so that a vertical position of the sample original can be adjusted as required.

4. A device according to claim 3, further comprising a light quantity detecting device for, when the pattern of the reference density on the sample original is illuminated with light from the exposing light source, detecting a quantity of light reflected from the sample original, a vertical position of the sample original to a top panel of the image formation apparatus being adjusted so that a quantity of light detected by the light quantity detecting device reaches a predetermined value.

* * * * *